US007342544B2

(12) United States Patent
Tsai et al.

(10) Patent No.: US 7,342,544 B2
(45) Date of Patent: Mar. 11, 2008

(54) ANTENNA WITH OVERLAPPING FIRST AND SECOND RADIATING ELEMENTS

(75) Inventors: Tiao-Hsing Tsai, Yungho (TW); Chieh-Ping Chiu, Yunlin Shien (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 81 days.

(21) Appl. No.: 11/304,252

(22) Filed: Dec. 14, 2005

(65) Prior Publication Data

US 2007/0057847 A1 Mar. 15, 2007

(30) Foreign Application Priority Data

Sep. 9, 2005 (TW) ..... 94131136 A

(51) Int. Cl.
*H01Q 1/24* (2006.01)

(52) U.S. Cl. ..... 343/702; 343/700 MS

(58) Field of Classification Search ..... 343/702, 343/700 MS, 725–729
See application file for complete search history.

(56) References Cited

U.S. PATENT DOCUMENTS

2005/0093752 A1* 5/2005 Cheng et al. ..... 343/702
2005/0219128 A1* 10/2005 Tan et al. ..... 343/702
2006/0038721 A1* 2/2006 Ozkar et al. ..... 343/700 MS
2006/0082503 A1* 4/2006 Gaucher et al. ..... 343/700 MS

* cited by examiner

*Primary Examiner*—Huedung Mancuso
(74) *Attorney, Agent, or Firm*—Ladas & Parry LLP

(57) ABSTRACT

An antenna includes a first radiating element, a feeding point, a grounding point, a second radiating element, and first and second conductive elements. The first radiating element has opposite first and second sides. The feeding point is provided on the first radiating element, and is disposed adjacent to the first side of the first radiating element. The grounding point is provided on the first radiating element, and is disposed adjacent to the second side of the first radiating element. The second radiating element is spaced apart from and overlaps the first radiating element. The first conductive element is disposed adjacent to the feeding point, and interconnects the first and second radiating elements. The second conductive element is disposed adjacent to the grounding point, and interconnects the first and second radiating elements.

8 Claims, 5 Drawing Sheets

ANTENNA WITH OVERLAPPING FIRST AND SECOND RADIATING ELEMENTS

CROSS-REFERENCE TO RELATED APPLICATION

This application claims priority of Taiwanese application No. 094131136, filed on Sep. 9, 2005.

BACKGROUND OF THE INVENTION

1. Field of the Invention

This invention relates to an antenna, more particularly to a dual band antenna.

2. Description of the Related Art

FIG. 1 illustrates a conventional dual band antenna 1 that operates both within the GSM 900 MHz bandwidth and the DCS 1800 bandwidth, that is mounted on a circuit board 100 of a mobile phone, and that includes a radiating element 10, feeding and grounding points 11, 12, and feeding and grounding lines 14, 15. The radiating element 10 is rectangular in shape, is spaced apart from and is disposed parallel to the circuit board 100, and has opposite first and second sides 101, 102 and opposite third and fourth sides 103, 104. The feeding point 11 is provided on the radiating element 10 proximate to a junction of the first and third sides 101, 103 of the radiating element 10. The radiating element 10 is formed with a slot 13 that extends from the fourth side 104 toward the feeding point 11. The grounding point 12 is provided on the radiating element 10 proximate to a junction of the second and third sides 102, 103 of the radiating element 10. The feeding line 14 connects electrically the feeding point 11 to the circuit board 100. The grounding line 15 connects electrically the grounding point 12 to the circuit board 100.

The aforementioned conventional antenna 1 is disadvantageous in that further reduction in size of the radiating element 10 is not feasible while maintaining operability within the GSM 900 MHz bandwidth and the DCS 1800 bandwidth.

SUMMARY OF THE INVENTION

Therefore, the object of the present invention is to provide an antenna that can overcome the aforesaid drawback of the prior art.

According to one aspect of the present invention, an antenna comprises a first radiating element, a feeding point, a grounding point, a second radiating element, and first and second conductive elements. The first radiating element has opposite first and second sides. The feeding point is provided on the first radiating element, and is disposed adjacent to the first side of the first radiating element. The grounding point is provided on the first radiating element, and is disposed adjacent to the second side of the first radiating element. The second radiating element is spaced apart from and overlaps the first radiating element. The first conductive element is disposed adjacent to the feeding point, and interconnects the first and second radiating elements. The second conductive element is disposed adjacent to the grounding point, and interconnects the first and second radiating elements.

According to another aspect of the present invention, a mobile phone comprises a housing and an antenna. The antenna includes a first radiating element, a feeding point, a grounding point, a second radiating element, and first and second conductive elements. The first radiating element has opposite first and second sides. The feeding point is provided on the first radiating element, and is disposed adjacent to the first side of the first radiating element. The grounding point is provided on the first radiating element, and is disposed adjacent to the second side of the first radiating element. The second radiating element is spaced apart from and overlaps the first radiating element, and serves as a portion of the housing. The first conductive element is disposed adjacent to the feeding point, and interconnects the first and second radiating elements. The second conductive element is disposed adjacent to the grounding point, and interconnects the first and second radiating elements.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
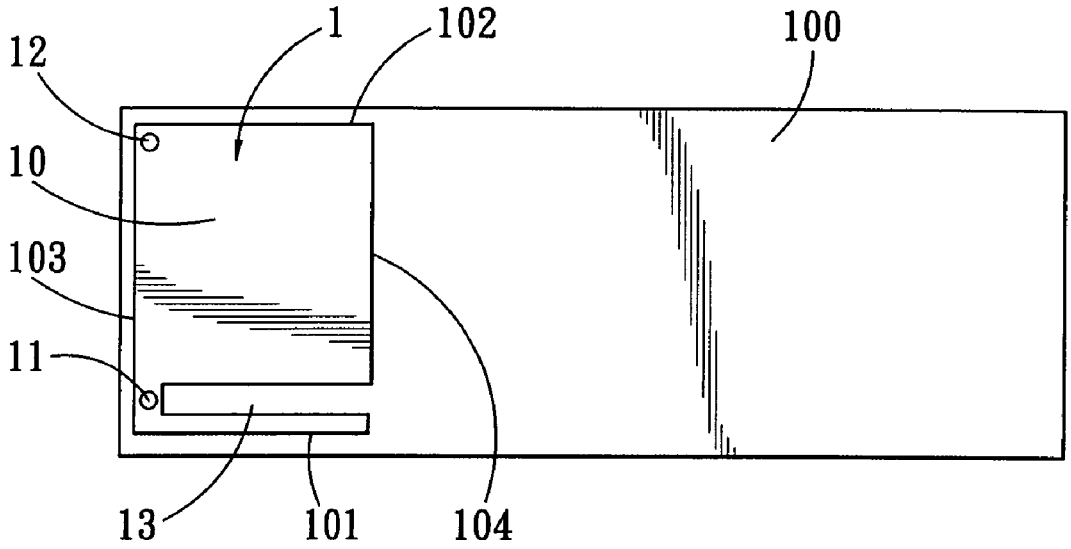
FIG. 1 PRIOR ART
FIG. 1 is a schematic view of a conventional dual band antenna mounted on a circuit board.
Figure 2:
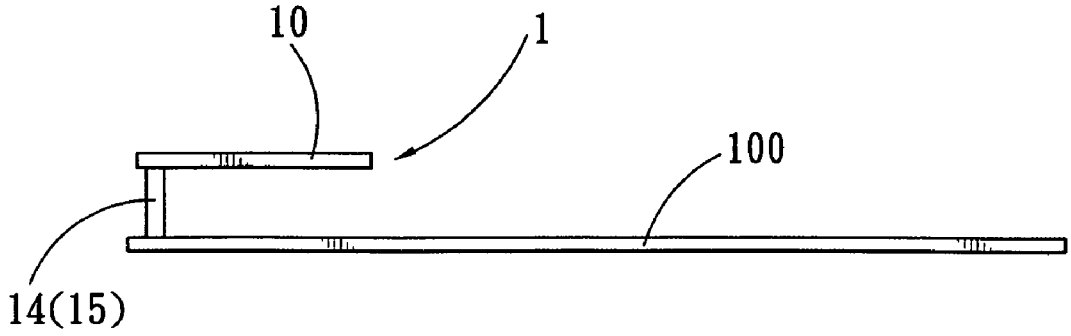
FIG. 2 PRIOR ART
FIG. 2 is a schematic view to illustrate feeding and grounding lines of the conventional dual band antenna.
Figure 3:
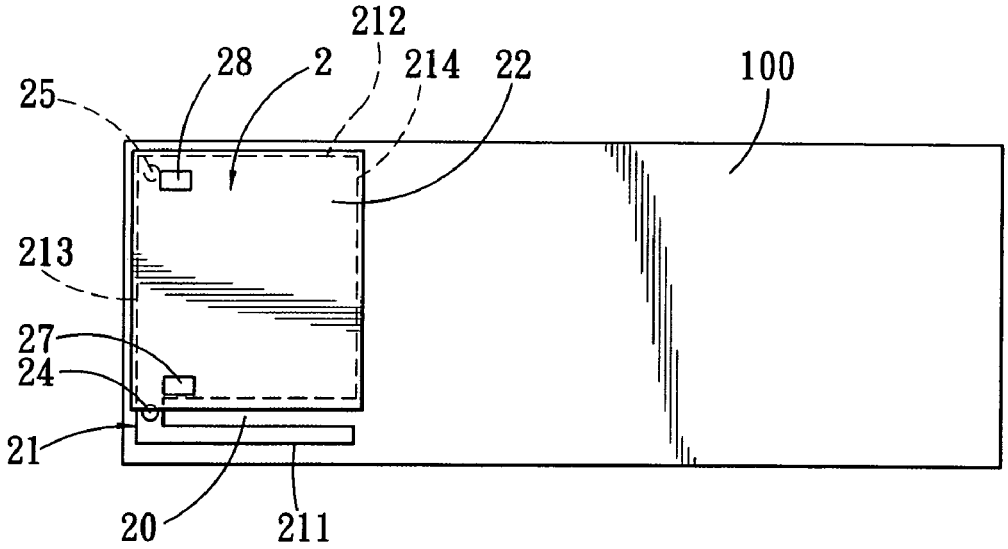
FIG. 3 is a schematic view of the preferred embodiment of an antenna according to the present invention.
Figure 4:
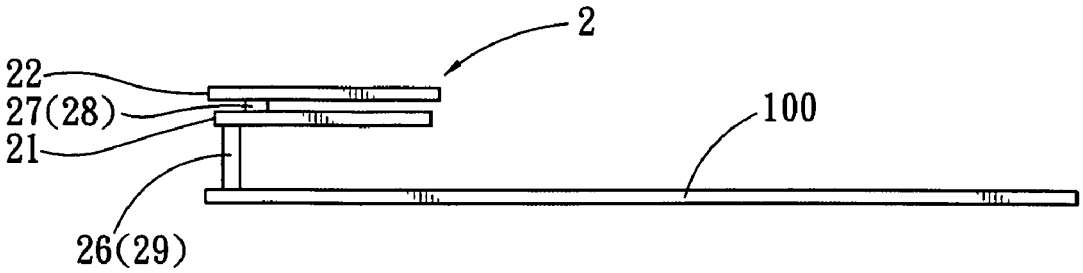
FIG. 4 is a schematic view to illustrate feeding and grounding lines of the preferred embodiment.

Referring to FIGS. 3 and 4, the preferred embodiment of an antenna 2 according to this invention is shown to include first and second radiating elements 21, 22, feeding and grounding points 24, 25, and first and second conductive elements 27, 28.

Figure 5:
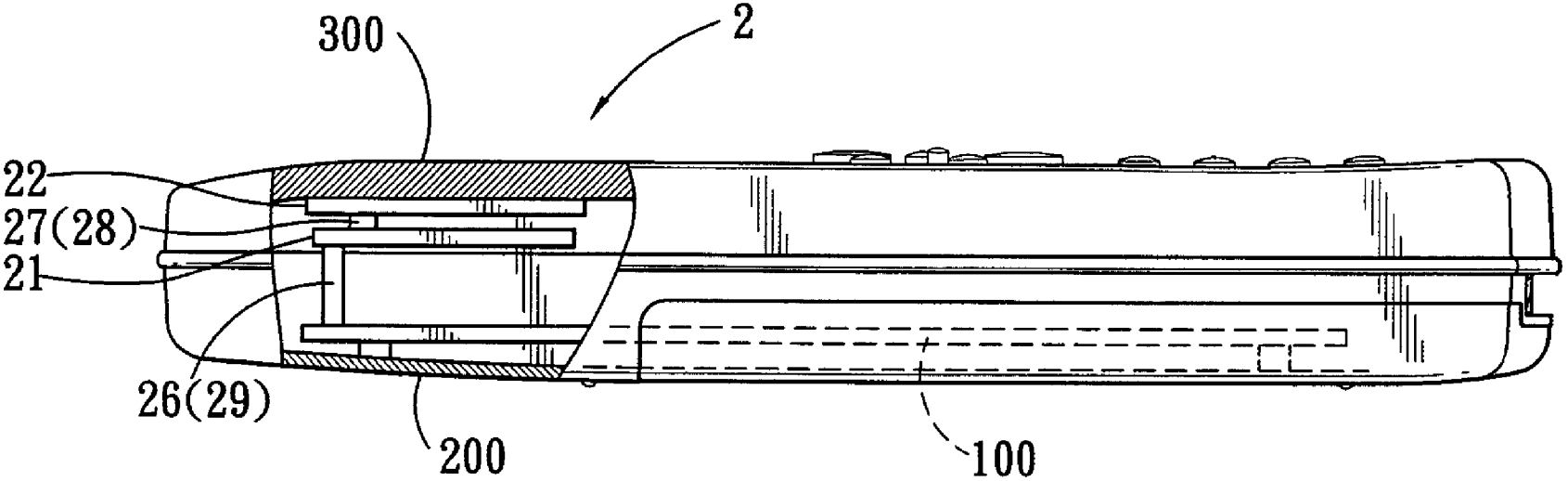
FIG. 5 is a schematic view to illustrate the preferred embodiment when applied to a mobile phone.

The antenna 2 of this embodiment is a dual band antenna that operates within the GSM 900 MHz bandwidth, as well as within the DCS 1800 MHz bandwidth, and that is mounted on a circuit board 100 of a mobile phone 200 (see FIG. 5).

The first radiating element 21 is generally rectangular in shape, is spaced apart from and is disposed parallel to the circuit board 100 of the mobile phone 200, and has opposite first and second sides 211, 212 and opposite third and fourth sides 213, 214.

The feeding point 24 is provided on the first radiating element 21, and is disposed adjacent to a junction of the first and third sides 211, 213 of the first radiating element 21.

The first radiating element 21 is formed with a slot 20 that extends from the fourth side 214 thereof toward the feeding point 24.

The grounding point 25 is provided on the first radiating element 21, and is disposed adjacent to a junction of the second and third sides 212, 213 of the first radiating element 21.

The second radiating element 22 is generally rectangular in shape, is spaced apart from and overlaps the first radiating element 21.

In this embodiment, each of the first and second radiating elements 21, 22 is made from a thin metal sheet.

The first conductive element 27 interconnects the first and second radiating elements 21, 22, and is disposed adjacent to the feeding point 24.

The second conductive element 28 interconnects the first and second radiating elements 21, 22, and is disposed adjacent to the grounding point 25.

The antenna 2 further includes feeding and grounding lines 26 and 29. The feeding line 26 connects electrically the feeding point 24 to the circuit board 100. The grounding line 29 connects electrically the grounding point 25 to the circuit board 100.

As illustrated in FIG. 5, the antenna 2 of this invention can be applied to the mobile phone 200 such that the second radiating element 22 serves as a portion of a housing 300 of the mobile phone 200, thereby reducing the space occupied by the antenna 2 of this invention in the housing 300 of the mobile phone 200.

Figure 6:
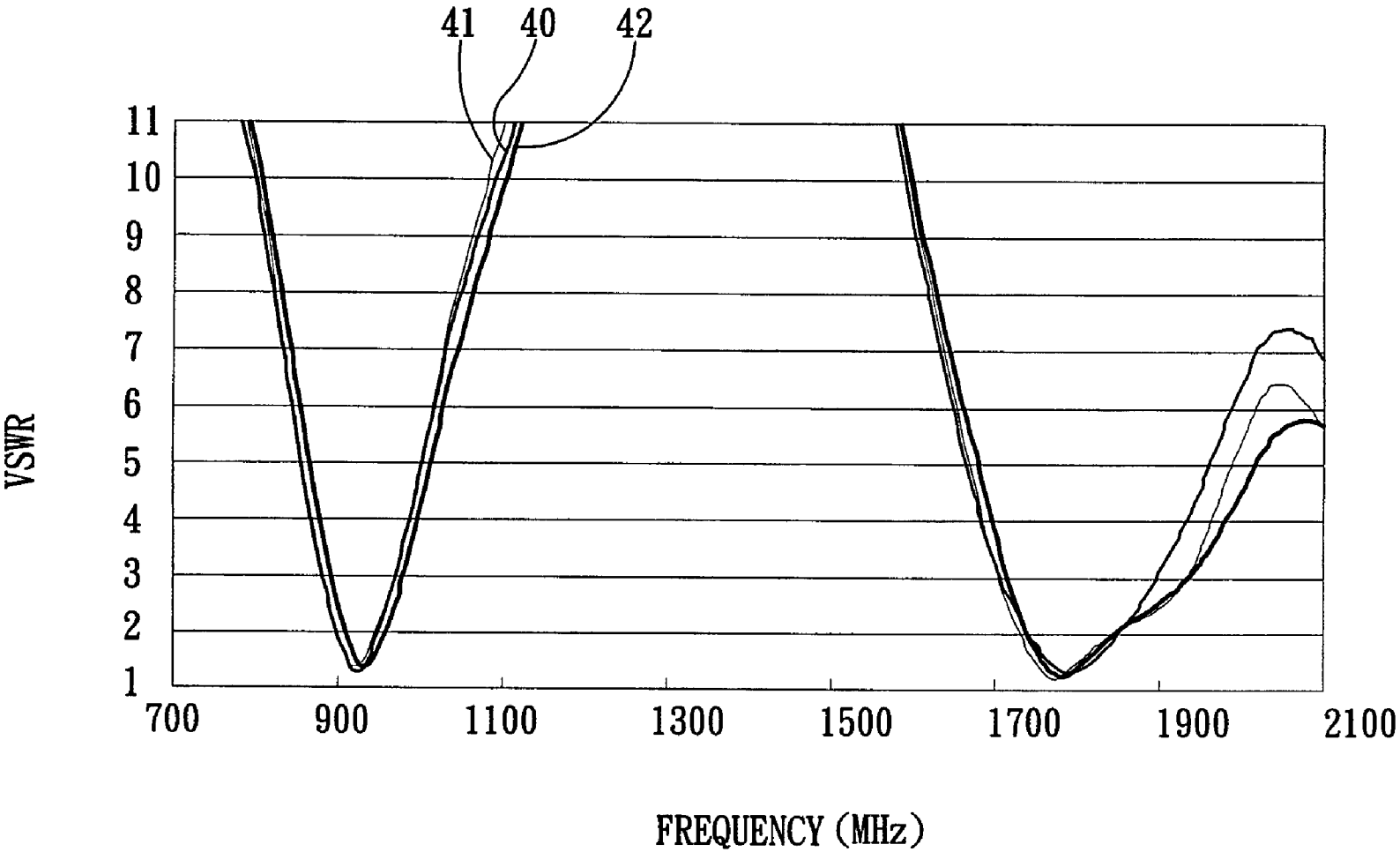
FIG. 6 is a plot to illustrate voltage standing wave ratios vs. frequency responses of the preferred embodiment.
Figure 7:
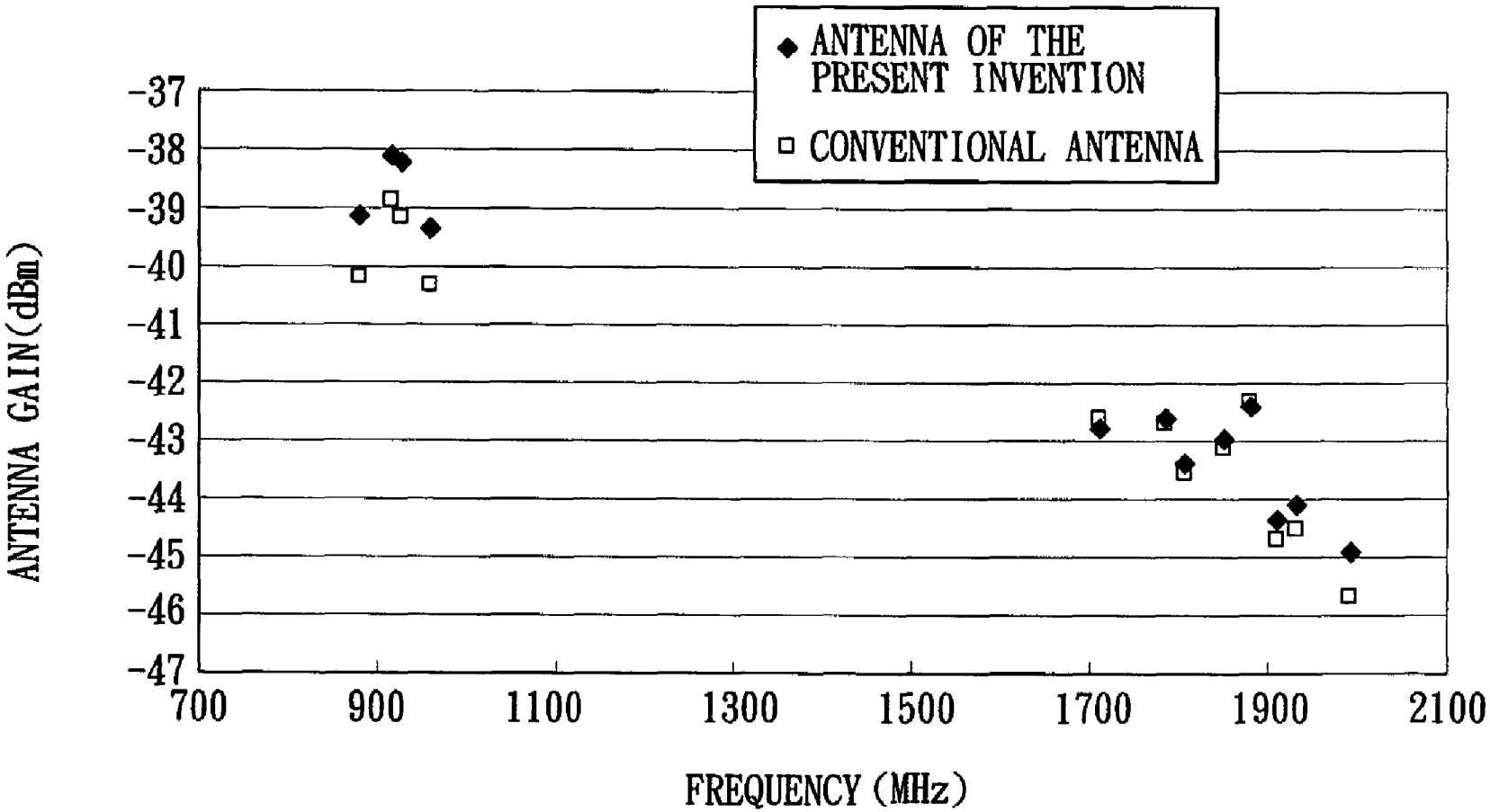
FIG. 7 is a plot to illustrate antenna gains of the preferred embodiment and the conventional dual band antenna.

FIG. 6 illustrates frequency responses 41, 40, 42 of the antenna 2 of this invention within the GSM 900 MHz bandwidth for large, medium, and small sizes of the first radiating element 21, respectively. It can be deduced that the frequency response of the antenna 2 of this invention may be adjusted simply by increasing and decreasing the size of the first radiating element 21. Furthermore, based from experimental results, as illustrated in FIG. 7, the antenna 2 of this invention has a higher antenna gain than the conventional dual band antenna within the GSM 900 MHz bandwidth.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna, comprising:

a first radiating element having opposite first and second sides;

a feeding point provided on said first radiating element, and disposed adjacent to said first side of said first radiating element;

a grounding point provided on said first radiating element, and disposed adjacent to said second side of said first radiating element;

a second radiating element spaced apart from and overlapping said first radiating element;

a first conductive element disposed adjacent to said feeding point, and interconnecting said first and second radiating elements; and a second conductive element disposed adjacent to said grounding point, and interconnecting said first and second radiating elements.

2. The antenna as claimed in claim 1, wherein each of said first and second radiating elements is made from a thin metal sheet.

3. The antenna as claimed in claim 1, wherein said first radiating element is generally rectangular in shape, and further has opposite third and fourth sides, said feeding point being disposed proximate to a junction of said first and third sides of said first radiating element, said first radiating element being formed with a slot that extends from said fourth side thereof toward said feeding point.

4. The antenna as claimed in claim 1, wherein said antenna is a dual band antenna that is operable within the 900 MHz bandwidth and the DCS 1800 MHz bandwidth.

5. A mobile phone, comprising:

a housing; and an antenna including a first radiating element disposed in said housing, and having opposite first and second sides, a feeding point provided on said first radiating element, and disposed adjacent to said first side of said first radiating element, a grounding point provided on said first radiating element, and disposed adjacent to said second side of said first radiating element, a second radiating element spaced apart from and overlapping said first radiating element, and serving as a portion of said housing, a first conductive element disposed adjacent to said feeding point, and interconnecting said first and second radiating elements, and a second conductive element disposed adjacent to said grounding point, and interconnecting said first and second radiating elements.

6. The mobile phone as claimed in claim 5, wherein each of said first and second radiating elements of said antenna is made from a thin metal sheet.

7. The mobile phone as claimed in claim 5, wherein said first radiating element of said antenna is generally rectangular in shape, and further has opposite third and fourth sides, said feeding point being disposed proximate to a junction of said first and third sides of said first radiating element, said first radiating element being formed with a slot that extends from said fourth side thereof toward said feeding point.

8. The mobile phone as claimed in claim 5, wherein said antenna is a dual band antenna that is operable within the 900 MHz bandwidth and the DCS 1800 MHz bandwidth.

* * * * *